United States Patent [19]

Gouch

[11] Patent Number: 4,893,558

[45] Date of Patent: Jan. 16, 1990

[54] IMAGE REPRODUCTION

[75] Inventor: Martin P. Gouch, Hertfordshire, England

[73] Assignee: Crosfield Electronics (USA) Limited, London, England

[21] Appl. No.: 290,807

[22] Filed: Dec. 23, 1988

Related U.S. Application Data

[63] Continuation of Ser. No. 44,263, Apr. 30, 1987, abandoned.

[30] Foreign Application Priority Data

May 12, 1986 [GB] United Kingdom ..... 8611555

[51] Int. Cl.[4] ..... B41F 5/06; B41F 5/16

[52] U.S. Cl. ..... 101/211

[58] Field of Search ..... 101/181, 248, 211; 250/372, 365

[56] References Cited

U.S. PATENT DOCUMENTS

| | | | |
|---|---|---|---|
| 3,105,908 | 10/1963 | Burkhardt et al. | 250/372 |
| 3,522,432 | 8/1970 | Ortlieb | 250/365 |
| 3,536,550 | 10/1970 | Von Hofe | 101/181 XR |
| 4,451,521 | 5/1984 | Kaule | 283/92 |

FOREIGN PATENT DOCUMENTS

| | | | |
|---|---|---|---|
| 0043724 | 6/1982 | European Pat. Off. . | |
| 0085157 | 2/1983 | European Pat. Off. . | |
| 187288 | 4/1982 | Japan . | |
| 93154 | 6/1982 | Japan | 101/181 |

*Primary Examiner*—J. Reed Fisher

*Attorney, Agent, or Firm*—Sughrue, Mion, Zinn, Macpeak & Seas

[57] ABSTRACT

A method of detecting the position of a feature, such as a register mark, in a color separation comprises printing the color separation on a substrate with an ink containing a pigment corresponding to the color of the separation and a dye which is detectable only when exposed to radiation outside the visible range. The printed color separation is exposed to the said radiation and the position of the feature in the printed color separation is determined by detecting radiation, such as fluorescence, from the dye.

4 Claims, 3 Drawing Sheets

IMAGE REPRODUCTION

This is a Continuation, of application Ser. No. 07/044,263, filed Apr. 30, 1987, now abandoned.

FIELD OF THE INVENTION

The invention relates to methods and inks for use in reproducing colour separations of images.

DESCRIPTION OF THE PRIOR ART

In colour printing, the image to be printed is defined in terms of a number of colour separations corresponding to respective printing inks and each colour separation is printed in succession onto a substrate. It is important that each separation is printed in register with the previously printed separations. In the past, this has conventionally been achieved by monitoring the positions of register marks printed to one side of the image at the same time as printing each colour separation and then adjusting the position at which the colour separations are printed to obtain the register marks at predetermined positions indicating the colour separations are registered.

In certain printing methods, particularly gravure printing, a web passes continuously through each of a number of printing stations, corresponding to each colour component, and registration of the web is controlled in real time. Thus, register marks are detected immediately following each pair of printing stations so that the position of the cylinders at the previous printing station can be adjusted so as to bring the colour separation printed at that station into register with the previously printed separation(s). In other printing methods, for example offset web printing, the web passes through the printing stations and after a first pass, the register marks are inspected to determine what corrections, if any, are needed for subsequent print runs to achieve registration of the colour separations. The feed associated with each printing station is then adjusted accordingly and further images then printed on the web.

An example of the use of register marks is described in EP-A-0043724. In this system invisible marks are provided on the web, the marks extending across the web in a special track. The marks are detected by irradiating the web with electromagnetic radiation which causes the mark to emit wavelength-shifted radiation which is then detected. This system is particularly designed for the packaging or container art in which the entire web is used after printing. It is important in this case that visible register marks are not used, since these will be undesirable in the finished product.

EP-A-0085157 illustrates a system for marking security documents such as bank cheques and the like with invisible bar codes. The bar codes are printed using an ink which fluoresces in the near infrared so that the bar code can be detected by automatic identification equipment but is normally invisible. In this case, the use of an invisible ink is important so as to maintain the bar code secret. This system has little relevance to the printing of coloured images involving the registration of colour separations and simply describes the printing of secret, invisible but detectable markings.

The main disadvantages of the known registration methods are the use of separate register marks in a special track extending across the web, as in EP-A-0043724 or extending alongside the edge of the web as in GB-A-1253426.

Recently, more sophisticated registration methods have been developed in the printing industry which involve detecting particular features within the image which have been previously printed to constitute the register marks. This avoids the need for separate register marks at the side of the image.

The difficulty which occasionally arises with this new registration method is that subsequently printed separations can obscure one or more of the features in the first printed colour separation which constitute the register marks.

SUMMARY OF THE INVENTION

In accordance with one aspect of the present invention, a method of detecting the position of a feature in a colour separation comprises printing the colour separation on a substrate with an ink containing a pigment corresponding to the colour of the separation and a dye which is detectable only when exposed to radiation outside the visible range; exposing the printed colour separation to the said radiation; and determining the position of the feature in the printed colour separation by detecting radiation from the dye.

The invention avoids the problems mentioned above by making use of a dye which is transparent in the visible wavelength range so that the colour of the ink is visually unaffected but which is detectable when exposed to radiation outside the visible wavelength range. This enables a feature which is to constitute a register mark to be detectable even if it has been overprinted with an ink which obscures the feature to exposure by visible light.

This invention should be contrasted with the known use of invisible register marks described above. Thus, the dye which is used in the invention is not used to print additional register marks as in the known arrangements but is used to enable detection equipment to identify visible features which may have been at least partially obscured by over printing.

Preferably, the dye fluoresces when exposed to suitable radiation and it is particularly preferable if the dye is detectable when exposed to infrared radiation. Although in theory dyes detectable with ultra-violet radiation could be used, the advantage of infrared dyes is that they never fluoresce to visible light and in addition infrared light does not damage optical components, unlike ultra-violet.

Typically, exposure of the printed colour separation to radiation can be achieved by using infrared diodes and the resulting fluorescence can be detected using infrared sensitive TV tubes.

The method is particularly applicable for use in registering colour separations and in accordance with a second aspect of the present invention, a method of printing colour separations comprises printing a colour separation on a substrate with an ink containing a pigment corresponding to the colour of the separation and a dye which is detectable only when exposed to radiation outside the visible wavelength range; exposing the printed colour separation to the said radiation; determining the degree of misregistration of at least one feature in the printed colour separation by detecting radiation from the dye; and subsequently printing the colour separation on a substrate with the said ink after correcting for the previously determined misregistration of the at least one feature.

Clearly, this method can be extended to three or more colour separations, each being registered with the first.

In some cases, it may be desirable to locate the same or different features in two or more of the colour separations, in which case it is preferable if the corresponding printing inks contain respective dyes which are detectable only when exposed to radiation outside the visible wavelength range and which emit (typically fluoresce or luminesce) in different wavelength bands.

In this latter case, the detection equipment may comprise infrared sensitive TV tubes with appropriate band pass filters.

The use of different dyes in the printing inks can also be utilised in a method of monitoring the registration of colour separations, the method comprising printing a plurality of colour separations on a substrate, each colour separation being printed with an ink containing a pigment corresponding to the colour of the separation and a dye which is detectable only when exposed to radiation outside the visible wavelength range, the dye associated with each colour separation emitting radiation in a respective wavelength band different from the wavelength bands of the other dyes; exposing the printed substrate to the said radiation; determining the position of at least one feature in each of the colour separations by detecting radiation from each of the dyes; and determining the degree of misregistration between the colour separations by comparing the previously determined positions of the at least one feature in each of the colour separations.

In accordance with a third aspect of the present invention, a printing ink comprises a pigment which, when printed, is visible; and a dye which is detectable only when exposed to infrared radiation.

Preferably, the dye fluoresces in response to exposure to infrared radiation.

A typical range over which dyes may suitably fluoresce is 300 nm to 2.2 μm. The range of irradiating radiation will typically be in the near infrared range of 700 nm to 1 μm.

Suitable dyes are organic dyes of the type used in IR laser dyes. Examples are laser dyes manufactured by Exciton: DTTC Iodide, HITC Iodide, and IR-125 Iodide.

BRIEF DESCRIPTION OF THE DRAWINGS

Some examples of printing apparatus for carrying out methods and using inks in accordance with the present invention will now be described with reference to the accompanying drawings, in which.

DETAILED DESCRIPTION OF THE EMBODIMENTS

Figure 1:
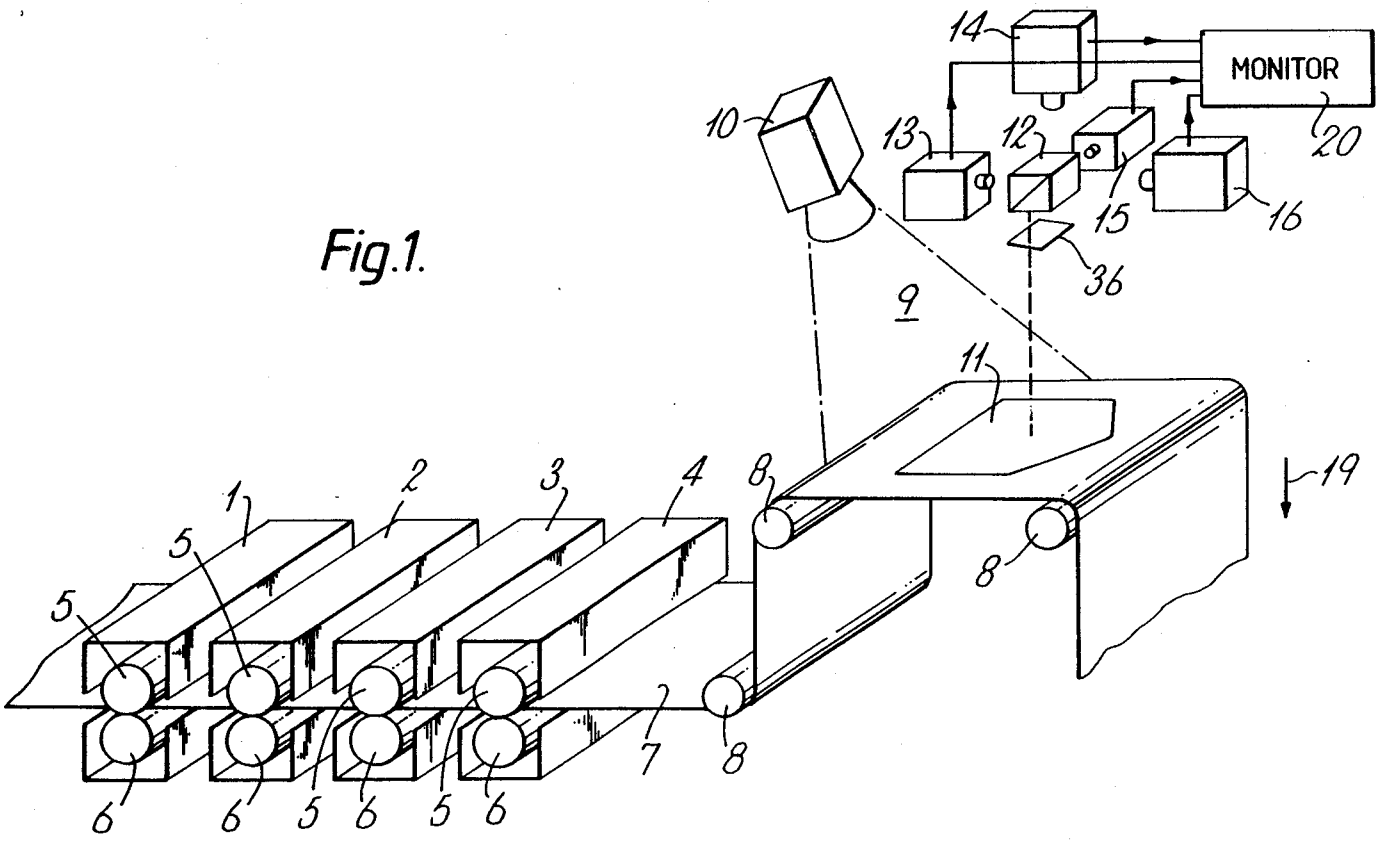
FIG. 1 is a schematic view of a first example of the printing apparatus.

The printing apparatus shown in FIG. 1 comprises four printing units 1–4 of conventional form each of which defines an offset printing unit having a pair of rollers 5, 6 between which an elongate web 7 passes. For simplicity, the printing forme and other rollers have been omitted. Each of the printing units 1–4 prints a respective colour separation onto the web 7. Typically, the colour components associated with each printing unit 1–4 will comprise cyan, magenta, yellow, and black respectively. Each printing ink used by the printing units thus contains a pigment corresponding to the colour of that separation.

In addition, each printing ink also includes a respective dye which is invisible under normal illumination but which fluoresces in response to exposure to infrared radiation. Each dye is chosen to fluoresce in a different wavelength band from the other dyes, typical dyes and their wavelength bands comprising:

Exciton DTTC Iodide which fluoresces at 820–860 nm;

HITC Iodide which fluoresces at 790–820 nm;

IR-125 Iodide which fluoresces at 860–950 nm; and

Zinsser Analytics 2, 5 Diphenyl oxazole which fluoresces at 320–400 nm (ultra-violet).

The web 7 is guided around rollers 8 through a detection station 9. At the detection station 9 is positioned an infrared light source 10 comprising for example one or more infrared diodes. This infrared source irradiates the entire surface of the web 7 within the detection station 9 including a picture 11 which has been printed on the web. The infrared radiation causes the dyes which have been printed to fluoresce in their respective wavelength bands and the emitted radiation is received after passing through a visible wavelength filter 36 in a dichroic beam splitter 12 positioned above the web 7 in the detection station. The beam splitter 12 responds to the wavelength of the incident radiation emitted by the dyes to pass radiation in respective wavelength bands to one of four conventional TV cameras 13–16. Each camera 13–16 thus corresponds to one of the colour components printed by the printing units 1–4 respectively.

Figure 2:
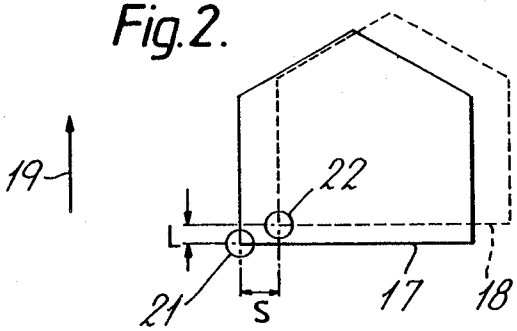
FIG. 2 illustrates an example of a feature used for register control.

Each camera 13–16 will detect an image of the picture 11 as defined by the corresponding dye irrespective of whether or not the visual pigment of that colour component has been obscured by the visual pigment of an overprinted colour component. For example, as shown in FIG. 2, the camera 13 may view an image 17 while the camera 14 may view an image 18 shown in phantom. It will be seen in FIG. 2 that these images are displaced relatively to one another indicating misregistration by an amount "L" in the direction of movement of the web (indicated by an arrow 19) and by an amount "S" (the sidelay) in the direction orthogonal to the web direction 19.

The images sensed by the cameras 13–16 are passed to monitoring circuitry 20 which includes conventional pattern recognition circuitry to detect certain features in the images which should be coincident. For example, the monitoring circuitry 20 could look for the feature 21 in the image 17 and try to match this with a corresponding feature 22 in the image 18. Once the two features have been detected, the monitoring circuitry can determine the correction factors L, S and in one form of the invention these correction factors can simply be displayed to the operator. The operator will then adjust the positions of the rollers 5, 6 and the web 7 as it passes through the respective printing units so that for subsequent print runs, the features 21, 22 will be printed in register.

It will be appreciated that no additional register marks are required to determine registration of the colour separations.

Figure 3:
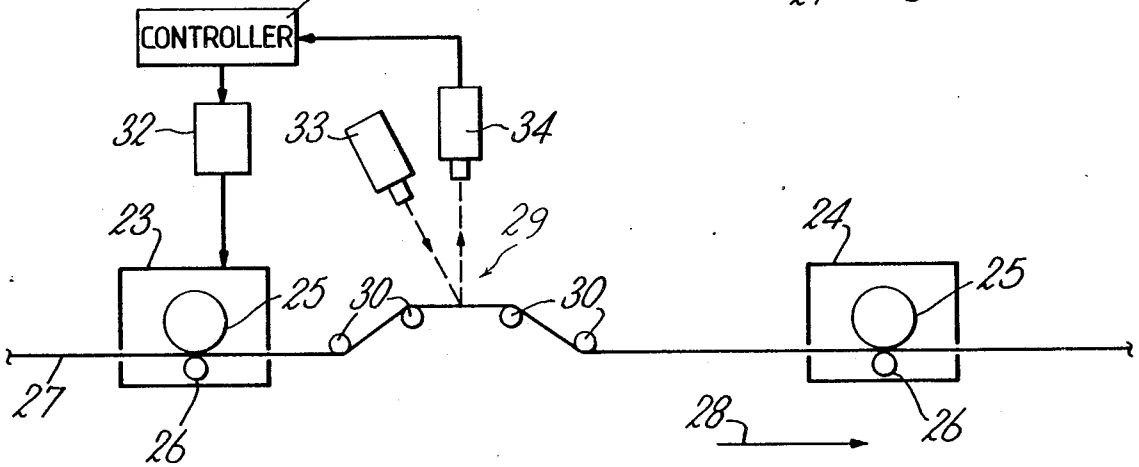
FIG. 3 is a schematic view of part of a second example of printing apparatus.

FIG. 3 illustrates a second form of the apparatus in which real time correction is achieved between printing units. The apparatus shown in FIG. 3 represents part of a gravure printing system having a number of printing units two of which 23, 24 are shown. Each printing unit 23, 24 comprises a gravure cylinder 25 and a pressure roller 26 between which a web 27 passes in the direction of an arrow 28. Between each pair of printing units is positioned a detection station, one of which 29 is shown in FIG. 3. Each detection station 29 comprises a number of rollers 30 about which the web 27 is entrained.

The detection station also includes an infrared light source 33, similar to the light source 10, and a TV camera 34 responsive to fluorescent radiation.

The first printing unit 23 prints a colour separation using an ink containing a pigment corresponding to the colour of the separation and a dye which is detectable (due to fluorescence) only when exposed to infrared radiation from the source 33. Each detection station 29 then causes that dye to flouresce by exposing the web 27 to infrared radiation from the respective source 33. Each TV camera 34 is responsive to radiation within the wavelength band of the respective fluorescing dye so as to generate an image of the first colour separation which is monitored by a controller 35 including a microprocessor. The controller 35 determines the position of one or more features in the first colour component using a conventional pattern recognition technique and compares the position of this feature with a predetermined position. If these are determined not to be in registration, the controller 35 causes a drive unit 32 to adjust the position of a web carrying roller (not shown) within the upstream printing unit so as to bring the feature into registration when the colour separation is next printed by that printing unit. A sidelay may also be corrected for by adjusting the lateral position of the web by a means not shown in FIG. 3. The means for correcting for lengthwise registration and sidelay may be of any conventional type and so are not described in detail.

I claim:

1. A method of detecting the positions of features in colour separations, comprising the steps of:

(a) successively printing a plurality of different colour separations on a substrate in superposed relationship, each including a detectable feature, with respective inks, each said ink containing both a visible pigment corresponding to the respective colour of each separation and a respective invisible dye which is detectable only when exposed to radiation outside the visible range, wherein the invisible dyes in each colour separation link individually emit radiation centered on different respective wavelengths;

(b) exposing said printed colour separations to said radiation; and (c) determining the positions of said features in said printed colour separations by individually detecting radiation from said dyes.

2. A method according to claim 1, wherein said dyes fluoresce when exposed to said radiation.

3. A method according to claim 1, wherein said exposing radiation comprises infrared radiation.

4. A method of monitoring the registration of colour separations, comprising the steps of:

(a) printing a plurality of different colour separations on a substrate in superposed relationship, each said colour separation being printed with a respective ink, each said ink containing both a visible pigment corresponding to the respective colour of said separation and a respective invisible dye which is detectable only when exposed to radiation outside the visible wavelength range, the dye associated with each said colour separation emitting radiation centered on a respective wavelength band different from the wavelength bands of the other dyes;

(b) exposing said printed substrate to said radiation;

(c) determining the position of at least one detectable feature in each of said colour separations by individually detecting radiation from each of said dyes; and (d) determining the degree of misregistration between said colour separations by comparing the previously determined positions of said at least one feature in each of said colour separations.

* * * * *